US009750304B2

(12) United States Patent
Kohatsu et al.

(10) Patent No.: US 9,750,304 B2
(45) Date of Patent: Sep. 5, 2017

(54) ARTICLE OF FOOTWEAR HAVING TALONAVICULAR SUPPORT

(71) Applicant: NIKE, Inc., Beaverton, OR (US)

(72) Inventors: Shane S. Kohatsu, Portland, OR (US); Paul J. Francis, Beaverton, OR (US); Andrea M. Vinet, Portland, OR (US); Michael S. Amos, Beaverton, OR (US); Thomas Foxen, Portland, OR (US); Lysandre Follet, Portland, OR (US); Troy C. Lindner, Portland, OR (US); John Hurd, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/984,790

(22) Filed: Dec. 30, 2015

(65) Prior Publication Data

US 2017/0188657 A1 Jul. 6, 2017

(51) Int. Cl.

| | |
|---|---|
| ***A43B 7/18*** | (2006.01) |
| ***A43B 7/14*** | (2006.01) |
| ***A43B 5/02*** | (2006.01) |
| ***A43B 5/14*** | (2006.01) |
| ***A43B 5/10*** | (2006.01) |
| ***A43B 5/06*** | (2006.01) |
| ***A43B 5/00*** | (2006.01) |
| ***A43B 23/02*** | (2006.01) |
| ***A43C 1/00*** | (2006.01) |
| ***A43B 13/18*** | (2006.01) |
| ***A43B 13/04*** | (2006.01) |

(Continued)

(52) U.S. Cl.

CPC ..... *A43B 7/18* (2013.01); *A43B 5/002* (2013.01); *A43B 5/02* (2013.01); *A43B 5/06* (2013.01); *A43B 5/10* (2013.01); *A43B 5/14* (2013.01); *A43B 7/142* (2013.01); *A43B 7/19* (2013.01); *A43B 13/04* (2013.01); *A43B 13/181* (2013.01); *A43B 13/187* (2013.01); *A43B 13/223* (2013.01); *A43B 23/021* (2013.01); *A43B 23/027* (2013.01); *A43B 23/028* (2013.01); *A43B 23/0215* (2013.01); *A43B 23/0275* (2013.01); *A43C 1/00* (2013.01); *A43C 15/16* (2013.01)

(58) Field of Classification Search

CPC ..... A43B 7/142; A43B 7/1495; A43B 7/18; A43B 7/19; A43B 7/20; A43B 13/181; A43B 13/187; A43B 23/0215; A43B 23/022; A43B 23/0275; A43B 23/027; A43B 23/028

USPC ..... 36/3 R, 3 A, 3 B, 91, 147, 148, 149

See application file for complete search history.

(56) References Cited

U.S. PATENT DOCUMENTS

| | | | | |
|---|---|---|---|---|
| 1,060,300 A | | 4/1913 | Webb | |
| 1,692,510 A | * | 11/1928 | Minutillo ..... | A43B 7/142 36/171 |

(Continued)

FOREIGN PATENT DOCUMENTS

| | | |
|---|---|---|
| FR | 2339355 | 8/1977 |
| GB | 328086 | 4/1930 |

*Primary Examiner* — Ted Kavanaugh

(74) *Attorney, Agent, or Firm* — Klarquist Sparkman, LLP

(57) ABSTRACT

An article of footwear includes a navicular support structure on a medial side. The navicular support structure includes a non-stretch, tensioned material that reduces an interior volume of the upper of the article of footwear and redirects applied forces from the midfoot region of the article of footwear to other regions, such as the forefoot region.

25 Claims, 10 Drawing Sheets

(51) Int. Cl.

| | |
|---|---|
| ***A43B 13/22*** | (2006.01) |
| ***A43C 15/16*** | (2006.01) |
| ***A43B 7/19*** | (2006.01) |

(56) References Cited

U.S. PATENT DOCUMENTS

| | | | | |
|---|---|---|---|---|
| 2,408,413 | A | 10/1946 | Doherty | |
| 5,401,564 | A * | 3/1995 | Lee | A43B 7/226 139/420 A |
| 6,401,366 | B2 * | 6/2002 | Foxen | A43B 7/1495 36/102 |
| 7,637,032 | B2 | 12/2009 | Sokolowski et al. | |
| 8,196,318 | B2 * | 6/2012 | Kosta | A43B 7/1495 36/108 |
| 8,205,357 | B2 | 6/2012 | Keating et al. | |
| 8,356,429 | B2 | 1/2013 | Eder et al. | |
| 8,584,378 | B2 | 11/2013 | Weidl et al. | |
| 2011/0030245 | A1 | 2/2011 | Truelsen | |
| 2011/0185597 | A1 * | 8/2011 | Guest | A43B 5/001 36/127 |
| 2011/0197475 | A1 * | 8/2011 | Weidl | A43B 1/0009 36/107 |
| 2011/0203137 | A1 * | 8/2011 | Long | A43B 5/12 36/91 |
| 2012/0198730 | A1 | 8/2012 | Burch et al. | |
| 2012/0324764 | A1 | 12/2012 | Velez-Cruz | |
| 2015/0282564 | A1 | 10/2015 | Meschter | |

* cited by examiner

ARTICLE OF FOOTWEAR HAVING TALONAVICULAR SUPPORT

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally used in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each impart different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each impart different properties to various areas of the footwear.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
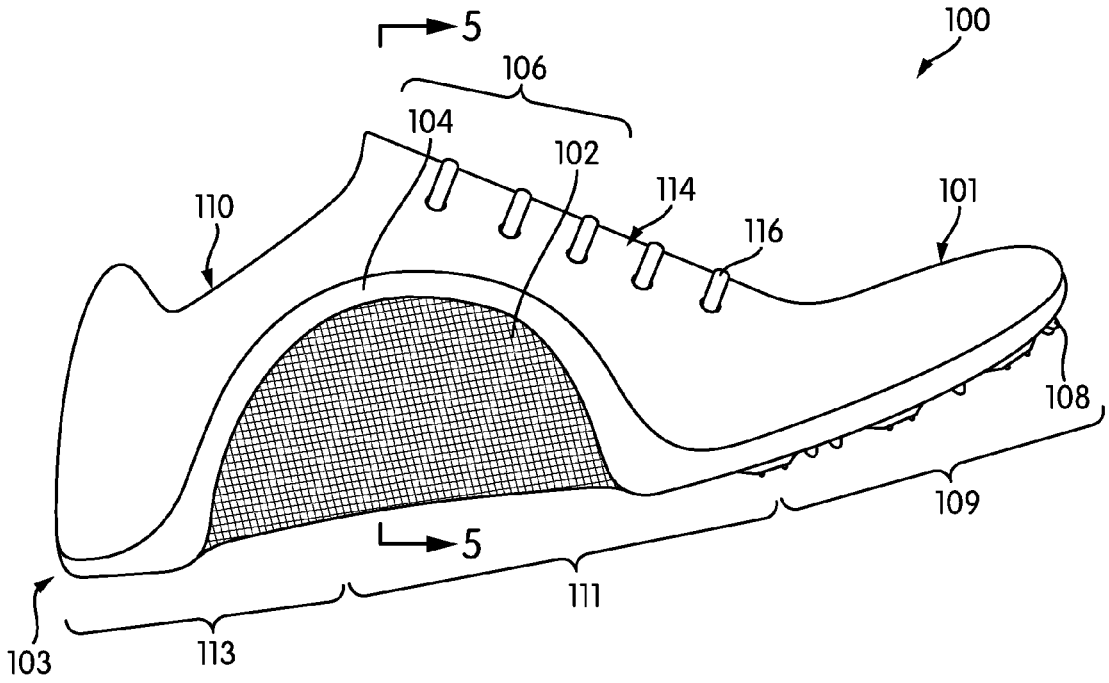
FIG. 1 is medial side view of an exemplary embodiment of an article of footwear with navicular support.

The following discussion and accompanying figures disclose a variety of concepts relating to articles of footwear. The article of footwear is designed to provide support to the talonavicular joint of the wearer, and in particular, the navicular bone of a wearer, which is believed to be the only bone in the body that experiences the full weight of a person when standing or running. When force is placed on the talonavicular joint and navicular bone, which is located in the arch of the foot, the talonavicular joint and navicular bone resist that pressure and support the weight of the person. However, if the force is high or repeated during high impact activity, such as when running, the talonavicular joint and navicular bone may experience more force than the talonavicular joint and the navicular bone can readily withstand, which may cause the talonavicular joint to flex to a sufficient degree to lead to discomfort.

FIGS. 1-5 show an exemplary embodiment of an article of footwear 100, also referred to simply as article 100, that includes provisions that support and protect the talonavicular joint 137 of a wearer. Shown in FIG. 3, talonavicular joint 137 is a joint in the foot where the talus bone 135 is connected to the navicular bone 133.

In some embodiments, article of footwear 100 may include an upper 101, a sole structure 103, and a navicular support structure 106. Generally, navicular support structure 106 is designed to reduce the interior volume of upper 101 proximate the talonavicular joint 137 compared to a conventional article of footwear to inhibit a tendency of the talonavicular joint 137 to spread or flex and extend into available space. As discussed in greater detail below, by eliminating the available space by reducing the interior volume of upper 101 with a supportive material, the talonavicular joint 137 of the wearer may be restricted to inhibit over-flexing the joint leading to discomfort. Further, navicular support structure 106 may redirect some of the applied forces to other parts of the foot and/or article 100. As discussed further below, navicular support structure 106 may include a pre-sprung material 102 that does not flex or otherwise distort in response to an applied force. Because pre-sprung material 102 retains its original shape when a force is applied, the applied forces travel through from the navicular support structure 106 and are dissipated towards other parts of the article of footwear.

Article 100 is shown as a cleated athletic article of footwear, although concepts associated with article 100 may also be applied to a variety of other athletic footwear types, including baseball shoes, basketball shoes, cycling shoes, football shoes, tennis shoes, running shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
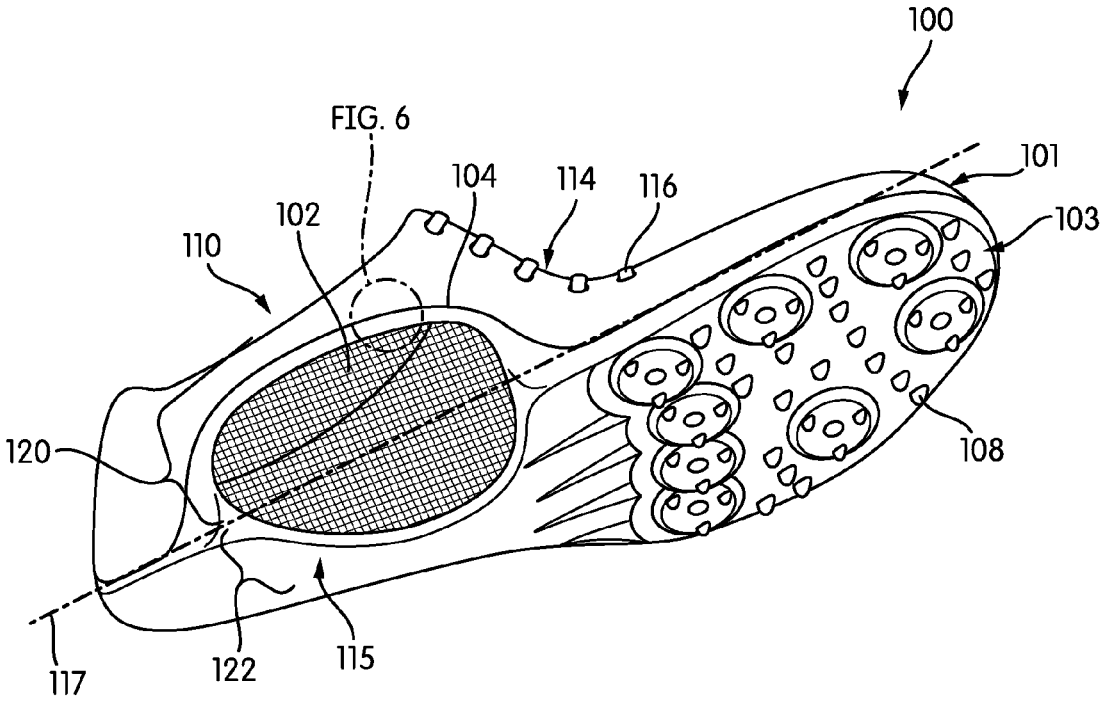
FIG. 2 is an isometric view of an exemplary embodiment of an article of footwear showing the sole structure of the article of footwear.
Figure 3:
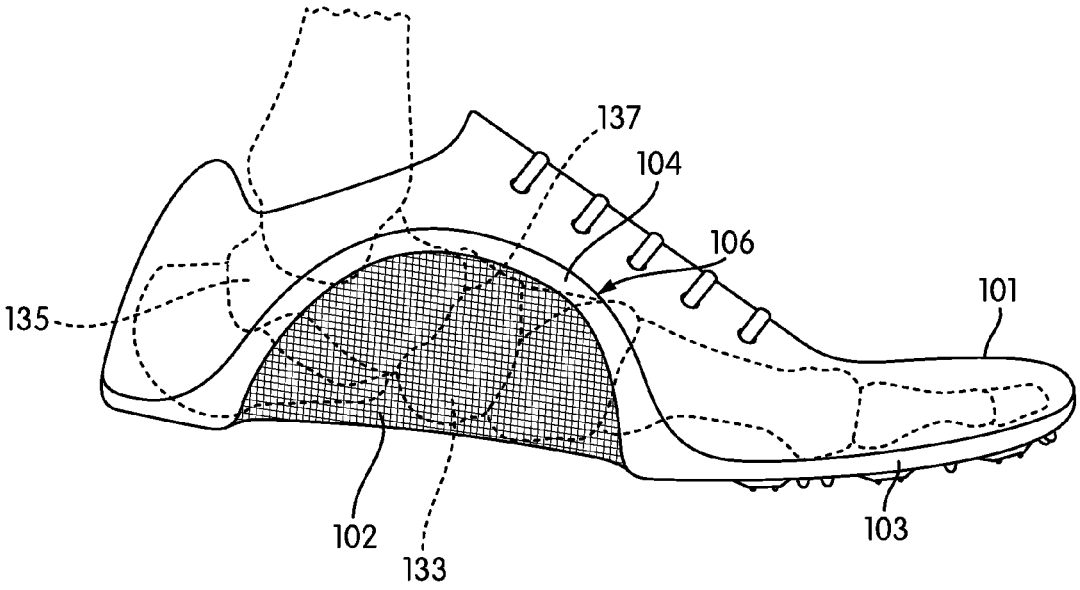
FIG. 3 is a medial side view of an exemplary embodiment of an article of footwear showing the alignment of the bones of the foot of a wearer with respect to the article of footwear.

For reference purposes, article 100 may be divided into three general regions: a forefoot region 109, a midfoot region 111, and a heel region 113, as shown in FIGS. 1-3. Forefoot region 109 generally includes portions of article 100 corresponding with the toes and the joints connecting the metatarsals with the phalanges. Midfoot region 111 generally includes portions of article 100 corresponding with an arch area of the foot, including the talonavicular joint 137 and the navicular bone 135 (shown in FIG. 3). Heel region 113 generally corresponds with rear portions of the foot, including the calcaneus bone. Article 100 also includes a lateral side 107 and a medial side 105 (shown in FIG. 5), which extend through each of forefoot region 109, midfoot region 111, and heel region 113, and which correspond with opposite sides of article 100. More particularly, lateral side 107 corresponds with an outside area of the foot (i.e., the surface that faces away from the other foot), and medial side 105 corresponds with an inside area of the foot (i.e., the surface that faces toward the other foot). Forefoot region 109, midfoot region 111, and heel region 113 and lateral side 107 and medial side 105 are not intended to demarcate precise areas of article 100. Rather, forefoot region 109, midfoot region 111, and heel region 113 and lateral side 107 and medial side 105 are intended to represent general areas of article 100 to aid in the following discussion. In addition to article 100, forefoot region 109, midfoot region 111, and heel region 113 and lateral side 107 and medial side 105 may also be applied to sole structure 103, upper 101, and individual elements thereof.

In some embodiments, upper 101 may be a continuous shell configured to receive and cover a wearer's foot. Upper 101 may form medial and lateral sidewalls of article 100. In some embodiments, upper 101 defines a void 118 (shown in FIG. 5) within article 100 for receiving a foot and securing the foot within void 118 relative to sole structure 103. Many conventional footwear uppers are formed from multiple material elements (e.g., textiles, polymer foam, polymer sheets, leather, synthetic leather) that are joined through stitching or bonding, for example. The material of upper 101 may have a first stretch resistance and a first rigidity.

Void 118 has a volume and is shaped to accommodate the foot and extends along a lateral side of the foot, along a medial side of the foot, over the foot, around the heel, and under the foot. Access to void 118 is provided by an opening 110 (shown in FIG. 1) located in at least heel region 113. More particularly, the foot may be inserted into upper 101 through opening 110, and the foot may be withdrawn from upper 101 through opening 110.

Article of footwear 100 includes a closure system 114. Closure system 114 may be any kind of closure system known in the art. In the embodiments shown, closure system 114 includes a lace 116 that extends through various lace apertures in upper 101 and permits the wearer to modify dimensions of upper 101 to accommodate proportions of the foot. More particularly, lace 116 permits the wearer to tighten upper 101 around the foot, and lace 116 permits the wearer to loosen upper 101 to facilitate entry and removal of the foot from void 118 (i.e., through opening 110.)

In an exemplary embodiment, sole structure 103 is secured to upper 101 and extends between the foot and the ground when article 100 is worn. In some embodiments, sole structure 103 may include one or more components, including a midsole, an outsole, and/or a sockliner or insole 119 (shown in FIG. 5). In an exemplary embodiment, sole structure 103 may include an outsole 115 that is secured to a lower surface of upper 101 at sole-upper attachment point 130 (shown in FIG. 5) and/or a base portion configured for securing sole structure 103 to upper 101. In some embodiments, sole structure 103 may be made from a material that is stiffer and more resilient than the material of upper 101 to provide protection for the foot of a wearer and/or traction for the article of footwear. In one embodiment, outsole 115 may be formed from a wear-resistant rubber material to impart traction. In other embodiments, outsole 115 may be made from other natural or synthetic materials, such as silicone, EVA, thermoset and thermoplastic polymers, or the like. In some embodiments, to improve traction, outsole 115 may include one or more traction elements 108, such as texture, cleats, or the like. Sole structure 103 may have a second stretch resistance and a second material rigidity, where the second stretch resistance and the second material rigidity are different from and greater than the first stretch resistance and the first material rigidity of upper 101. Although this configuration for sole structure 103 provides an example of a sole structure that may be used in connection with upper 101, a variety of other conventional or nonconventional configurations for sole structure 103 may also be used. Accordingly, in other embodiments, the features of sole structure 103 or any sole structure used with upper 101 may vary.

In some embodiments, article of footwear 100 is configured to support talonavicular joint 137, particularly proximate the navicular bone 135, to inhibit a tendency of talonavicular joint 137 to spread in response to applied forces, such as the force of pressing the foot against a surface while walking, running, jumping, or standing. Article of footwear 100 may include provisions designed to support the talonavicular joint 137 on medial side 105 of the article of footwear 100.

As shown in FIG. 1, in some embodiments, article of footwear 100 may include talonavicular support structure 106, which in some embodiments may be an assembly that may include a frame 104 that defines an aperture 112 (shown best in FIG. 4) and a pre-sprung material 102 disposed in aperture 112. In general, talonavicular support structure 106 is intended to support talonavicular joint 137 and inhibit spreading of talonavicular joint 137 by reducing the volume of void 118 and to provide a rigid, non-stretch portion of article of footwear 100 proximate talonavicular joint 137 so that neither upper 101 nor sole structure 103 flexes or gives proximate talonavicular joint 137 in response to applied forces.

Figure 4:
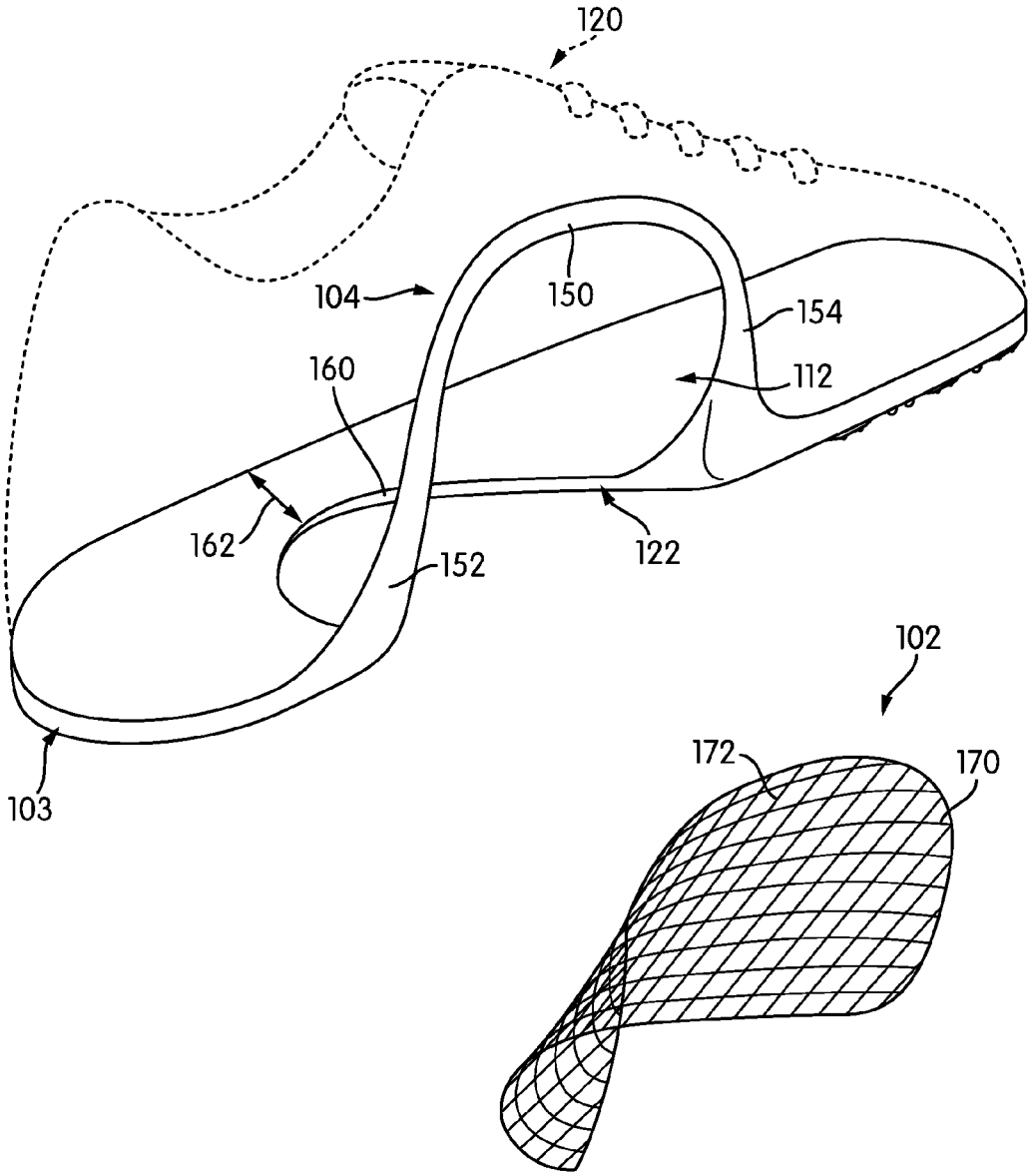
FIG. 4 is an exploded view of the article of footwear, with the upper of the article of footwear shown in phantom.

In some embodiments, frame 104 may be a material that is more rigid than the material of upper 101. The rigidity of frame 104 may assist in providing a portion of article of footwear 100 that does not flex or give in response to applied forces to support talonavicular joint 137. This rigidity allows frame 104 to act as a buttress for talonavicular joint 137. By buttressing talonavicular joint 137 with a rigid support structure like talonavicular support structure 106, the energy loss in and unwanted movement of the talonavicular joint 137 may be minimized. Rigid support structure 106 provides an unyielding or minimally yielding surface with little or no give against which the user's foot may press instead of allowing the talonavuclar joint 137 to move or spread. In some embodiments, frame 104 may be an extension of sole structure 103, as shown in FIG. 4.

In some embodiments, frame 104 may extend continuously from sole structure 103. In some embodiments, frame 104 and sole structure 103 may be formed as a unitary component so that sole structure 103 may define a portion of aperture 112. In other embodiments, frame 104 may be formed separately from sole structure 103 and attached to sole structure 103 using any method known in the art, such as with adhesives, heatbonding, welding, or the like. Frame 104 may be directly attached to sole structure 103, or frame 104 may be indirectly attached to sole structure 103, with another component such as a portion of upper 101 positioned between frame 104 and sole structure 103. In some embodiments, frame 104 may be a continuous extension of sole structure 103 so that frame 104 and sole structure 103 form a monolithic element.

In some embodiments, frame 104 may be made from the same material as sole structure 103 and may have the same stretch resistance and material rigidity as that of sole structure 103. In other embodiments, frame 104 may be made from a different material than sole structure 103. In some embodiments, frame 104 may be made from a material that is complementary to or compatible with the material of upper 101 so that the attachment of frame 104 to the material of upper 101 such as by welding or adhesive bonding may be readily achieved. In some embodiments, frame 104 may be made from a material that can behave as an adhesive without the use of additional materials, such as ethylene vinyl acetate (EVA), so that frame 104 may be directly attached to upper 101 by using heat and pressure.

The portion of frame 104 in upper 101, upper frame portion 120 as shown in FIG. 2, may be associated with upper 101 using any method known in the art. For example, frame 104 may be bonded to upper 101 with an adhesive, welded, sewn, heatbonded, or otherwise mechanically connected to upper 101.

The shape of frame 104 may be any shape capable of supporting pre-sprung material 102. In some embodiments, frame 104 may be shaped to generally follow the contours of a wearer's foot proximate talonavicular joint 137 for the comfort of the wearer given the relative rigidity of frame 104 compared to the rigidity of upper 101. In some embodiments, frame 104 may form an arcuate shape on upper 101. In some embodiments, such as the embodiments shown in the figures, frame 104 may extend in an arcuate shape that follows a contour of a foot from a sole-upper interface line 117 (shown in FIG. 2) proximate a heel region, to a point proximate a throat opening, and back to the sole-upper interface line 117 proximate the forefoot region. Sole-upper interface line 117 is an imaginary line that extends along an upper part of sole structure 103 and across navicular support structure 106 as though sole structure 103 and upper 101 were co-extensive continuously through the midfoot region instead of being interrupted by navicular support structure 106. In the embodiment shown in FIG. 4, frame 104 may include a heel-side bar 152 and a forefoot-side bar 154 that each extend from sole-upper interface line 117. A cross bar 150 extends across upper 101 between heel-side bar 152 and forefoot-side bar 154. Together, these bars may form the arcuate shape of frame 104.

Each bar, cross bar 150, heel-side bar 152, and forefoot-side bar 154, may have a curvature in one or more planes. The curvature may be in the heel-to-toe direction, the medial-to-lateral direction, a sole structure-to-upper direction, or a combination of these directions. The curvature of the bar or bars may be designed to follow the contours of a foot and/or an arch region of a foot for comfort. The curvature of the bar or bars may also impart a curvature to pre-sprung material 102, as will be discussed in more detail below with respect to FIGS. 10 and 11.

The size of frame 104 may be any size sufficient to support talonavicular joint 137. In some embodiments, frame 104 extends from a position on sole structure 103, across a sole-upper interface line 117 (shown in FIG. 2), and up medial side 105 of upper 101. In those embodiments where frame 104 extends across sole-upper interface line 117, such as is shown in FIG. 2, frame 104 may include an upper frame portion 120 and a sole frame portion 122. Upper frame portion 120 is the portion of frame 104 that is positioned on and follows the contours of upper 101. Sole frame portion 122 is the portion of frame 104 that is positioned on and follows the contours of sole structure 103; a bend of frame 104 between upper frame portion 120 and sole frame portion 122 accommodates the different planes of sole structure 103 and upper 101. In some embodiments, such as the embodiment shown in FIG. 4, sole frame portion 122 is unitary with sole structure 103 so that a portion of sole structure 103 defines frame 104 and directly supports pre-sprung material 102.

In some embodiments, frame 104 may extend from sole-upper interface line 117 to a point on upper 101. In some embodiments, frame 104 may extend to a point on upper 101 proximate closure system 114 and/or throat opening 110. In some embodiments, frame 104 may be large enough to completely surround a portion of the wearer's foot corresponding to talonavicular joint 137. In some embodiments, frame 104 may be large enough so that navicular support structure 106 may extend entirely from sole-upper interface line 117 to closure system 114. In other embodiments, navicular support structure 106 may extend only partially from sole-upper interface line 117 towards closure system 114. The length of navicular support structure 106 may be selected so that the talonavicular joint is surrounded by navicular support structure 106. In some embodiments, navicular support structure 106 may extend at least 50%, at least 60%, at least 70%, at least 80%, or at least 90% of the length between sole-upper interface line 117 towards closure system 114. When navicular support structure 106 is larger, the level of support to the navicular joint may be greater than in shorter embodiments. When navicular support structure 106 is shorter, the level of comfort to the wearer may be greater than in longer embodiments. A designer may select the precise length that navicular support structure 106 extends from sole-upper interface line 117 towards closure system 114 depending on the level of desired support. For example, an athletic shoe intended for running or other high impact use may be provided with a longer navicular support structure 106 to maximize support. In other embodiments, such as shoes for low impact activities, navicular support structure 106 may be shorter to maximize comfort while still providing talonavicular support.

In those embodiments where frame 104 extends from a position on sole structure 103 to a position on upper 101, frame 104 may be considered to be partially underneath a wearer's foot and partially beside a wearer's foot when article 100 is worn or partially on upper 101 and partially beneath upper 101. Similarly, pre-sprung material 102 and navicular support structure 106 may also be considered to be partially on upper 101 and partially beneath upper 101 when frame 104, pre-sprung material 102, and navicular support structure 106 extend from a position on sole structure 103 to a position on upper 101.

Figure 5:
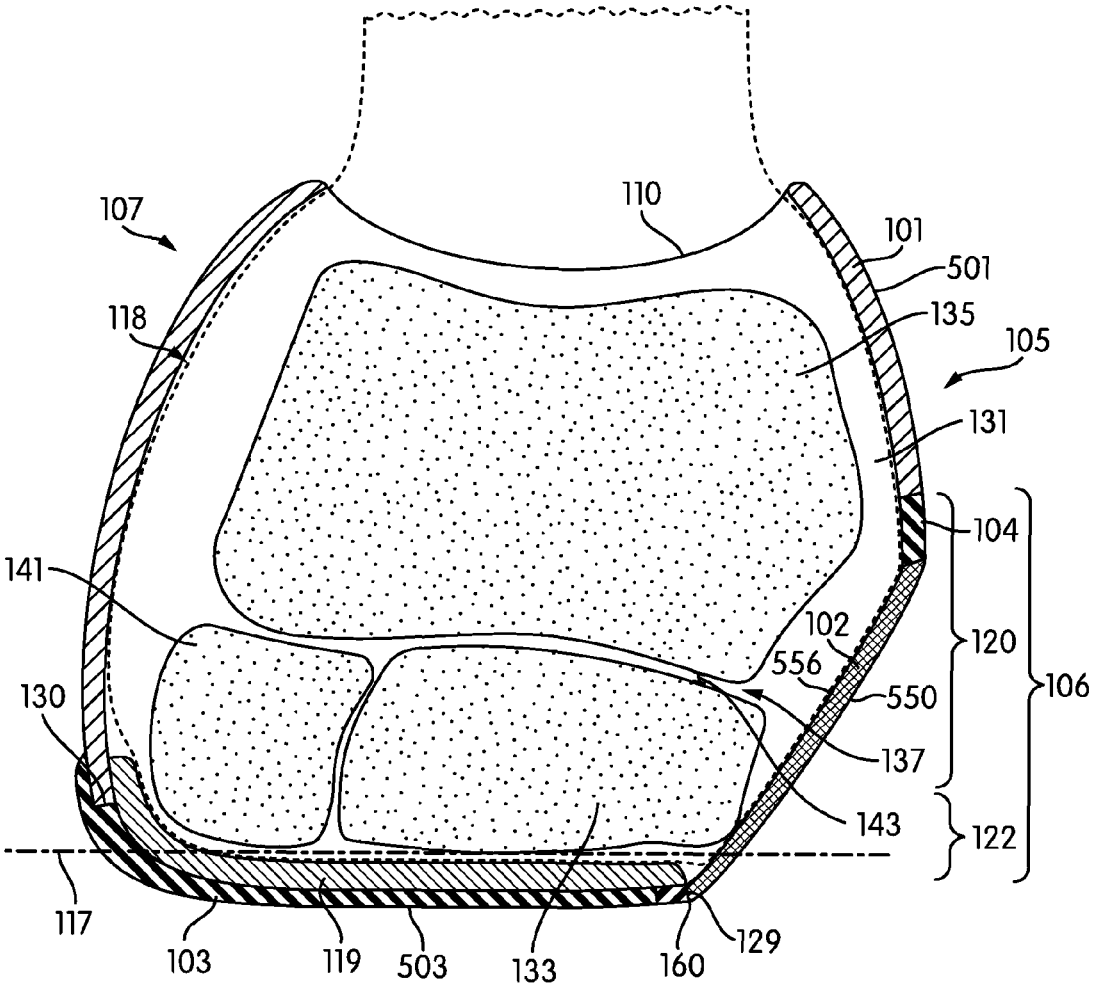
FIG. 5 is a cross-sectional view of the article of footwear taken along line 5-5 in FIG. 1 showing the alignment of the bones of the foot of a wearer with respect to the article of footwear when no forces are being applied to the foot or the article of footwear.

Frame 104 may be positioned anywhere on medial side 105 and may form a portion of the medial sidewall so that navicular support 106 may align with talonavicular joint 137 to inhibit excessive movement of talonavicular joint 137. In some embodiments, frame 104 may be positioned in midfoot region 111. In some embodiments, frame 104 may be positioned partially in heel region 113 and partially in midfoot region 111. In some embodiments, frame 104 may be positioned partially in forefoot region 109 and partially in midfoot region 111. In some embodiments, frame 104 may be positioned at least partially in heel region 113, across midfoot region 111, and at least partially in forefoot region 109. As shown in FIG. 5, in some embodiments, frame 104 is sized and positioned so that a center of frame 104 corresponds to talonavicular joint 137. In some embodiments, frame 104 is sized and positioned so that a center of frame 104 corresponds to navicular bone 133.

Frame 104 is configured to support pre-sprung material 102. For the purposes of this disclosure, "pre-sprung material" is a material that has substantially no stretch under typical use conditions. Pre-sprung material 102 may be placed under tension when positioned on the article. Pre-sprung material 102 is designed to have little or no stretch when subjected to forces such as those applied when the wearer's foot impacts a ground surface, such as during walking or running but also when standing. In some embodiments, pre-sprung material 102 may exhibit some stretch under extreme forces. However, pre-sprung material 102 will have greater stretch resistance than the material of upper 101.

Pre-sprung material 102 may be any type of material known in the art that meets these criteria. For example, in some embodiments, pre-sprung material 102 may be a solid sheet or film of material. In some embodiments, pre-sprung material 102 may be a woven, nonwoven, or any other type textile. In some embodiments, such as the embodiments shown in the figures, pre-sprung material 102 may be a mesh having horizontal cables 170 and vertical cables 172, as shown in FIG. 4.

Pre-sprung material 102 may be made from natural or synthetic materials. In some embodiments, pre-sprung material 102 may be made from synthetic fibers or cables, such as aramid fibers, including but not limited to poly-paraphenylene terephthalamide (Kevlar®). For the purposes of this disclosure, a cable may be considered to be thicker than a fiber. For example, in some embodiments, a cable may be made of multiple fibers. When using fibers or cables such as poly-paraphenylene terephthalamide, pre-sprung material 102 may be woven or otherwise formed into a mesh or textile that can be positioned within aperture 112 to provide continuity to upper 101 and/or sole structure 103 while also providing support for the talonavicular joint 137 and comfort for the wearer. While pre-sprung material 102 may not be intended to give, flex, or stretch in response to applied forces from the foot of the wearer, the shape of pre-sprung material 102 may be selected to conform to the shape of a wearer's foot proximate talonavicular joint 137 to allow for a comfortable fit while resting or while engaged in activity, such as standing, walking, and running.

In the embodiments shown in the figures and in the discussion below, pre-sprung material 102 may be placed under tension when positioned within aperture 112. Pre-sprung material 102 may have any shape known in the art capable of extending into void 118 to reduce the interior volume of upper 101. In some embodiments, pre-sprung material 102 may have a concave shape, i.e., pre-sprung material 102 curves away from a surface of upper 101 and sole structure 103 into void 118. This curvature, as discussed in more detail below with respect to FIGS. 10 and 11, may be provided by a compound curvature of frame 104. In other embodiments, such as the embodiment shown in FIGS. 1-5, pre-sprung material 102 may extend straight across aperture 112.

FIG. 5 shows a cross-section of article 100 so that medial side 105, which sidewall includes navicular support structure 106 as part of the medial sidewall of upper 101, may be compared to lateral side 107, which sidewall does not include a similar support structure. As seen in FIG. 5, on lateral side 107, sole structure 103 is directly attached to upper 101 at sole-upper attachment point 130. On medial side 105, sole frame portion 122 is attached directly to sole structure 103 and upper frame portion 120 is attached directly to upper 101; this allows frame 104 to be attached to or embedded within sole structure 103 and upper 101. Pre-sprung material 102 may be attached to frame 104 at upper attachment point 126 and lower attachment point 128. In some embodiments, pre-sprung material 102 may extend across frame 104. In some embodiments, pre-sprung material 102 may curve into void 118 to form a concave structure. While the contour of pre-sprung material 102 may be any concave shape, in some embodiments, the contour of pre-sprung material 102 may be designed to follow the contours of an arch region of a foot or the portion of the foot pre-sprung material 102 is intended to contact. Because pre-sprung material 102 is designed to have little or no flex or give, a contour that corresponds to the contour of a foot may be more comfortable than a contour that does not correspond to the contour of a foot, particularly for periods of long wear or use.

Navicular support structure 106 may be positioned on article of footwear 100 so that pre-sprung material 102 may be exposed or visible on an exterior surface 501 of article of footwear 100. As shown in FIG. 5, pre-sprung material 102 is positioned so that an inner pre-sprung surface 556 faces into void 118 and may contact a wearer's foot. Pre-sprung material 102 has an outermost surface 550 that aligns with exterior surface 501 of article of footwear 100 and effectively forms a part of exterior surface 501 of both upper 101 and sole structure 103. Therefore, pre-sprung material 102 may be exposed to an observer even when article of footwear 100 is being worn.

In some embodiments, such as the embodiment shown in FIG. 5, attachment material may be positioned at upper attachment point 126 and/or sole attachment point 128. In some embodiments, the attachment material may not only attach pre-sprung material 102 to frame 104, but may also have a stiffness and/or stretch resistance that is selected to ease the material discontinuities between pre-sprung material 102 and frame 104. In some embodiments, frame 104 may be co-formed with pre-sprung material 102, such as by co-molding or overmolding frame 104 with pre-sprung material 102.

Pre-sprung material 102 may be attached to frame 104 using any method known in the art, such as with adhesives, welding, stitching, heatbonding, or any other method known in the art for connecting materials together. In some embodiments, an attachment material such as an adhesive film may be provided to attach pre-sprung material 102 to frame 104.

Figure 6:
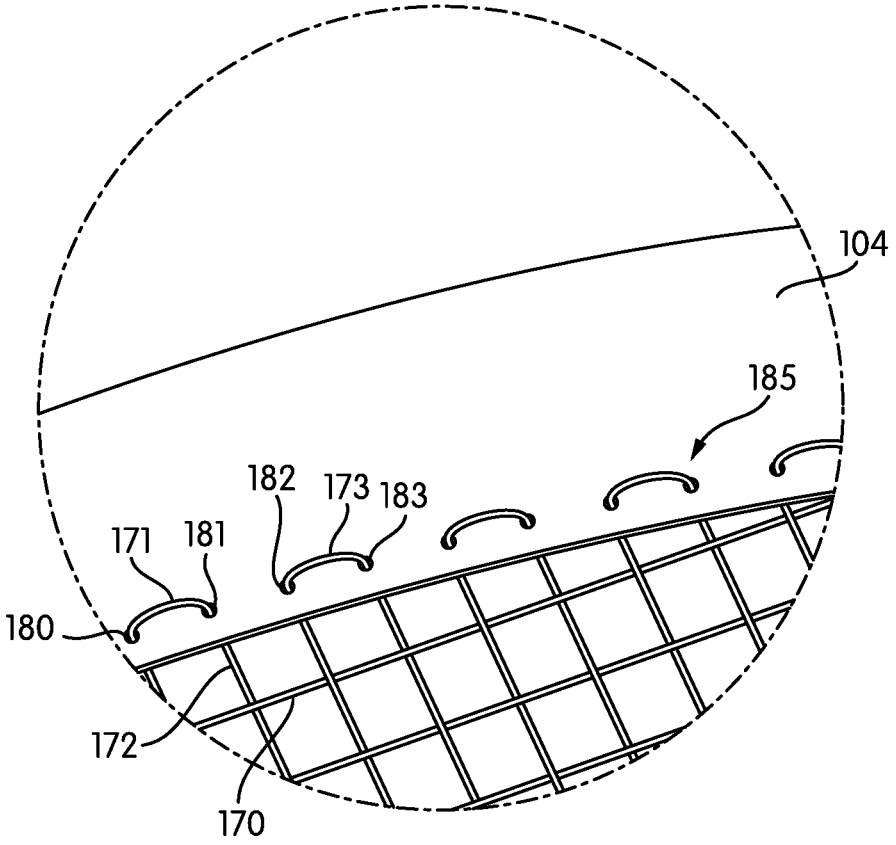
FIG. 6 is an enlarged view of a portion of a navicular support structure showing an embodiment of how a pre-sprung element may be attached to a frame.

In some embodiments, pre-sprung material 102 may be separately formed and attached to frame 104 using any method known in the art, such as with mechanical connectors, adhesives, heat bonding, welding, or the like. In some embodiments, pre-sprung material 102 may be mechanically connected to frame 104 by threading pre-sprung material 102 through receptacles or holes on frame 104, similar to stringing a tennis racket or a snowshoe. An embodiment of a stringing attachment system 185 is shown in FIG. 6. In FIG. 6, frame 104 may include multiple holes such as first hole 180, second hole 181, third hole 182, and fourth hole 183. First hole 180, second hole 181, third hole 182, and fourth hole 183 may be formed on cross bar 150 (shown in FIG. 4) of frame 104. Vertical cables 172 of the mesh may be threaded through these holes to both form and attach the mesh to frame 104. In some embodiments, vertical cables 172 are extended up through one hole, extend along frame 104 to an adjacent hole, and then down through the adjacent hole to extend across aperture 112. For example, a first mesh portion 171 spans from first hole 180 to second hole 182, a second cable portion 173 spans from third hole 182 to fourth hole 183. This pattern of cable portions on frame 104 may extend partially or entirely around the circumference of frame 104. As will be recognized by those of skill in the art, horizontal cables 170 may be attached to different portions of frame 104, such as heelward bar 152 or forefoot bar 154 in a similar manner.

Figure 7:
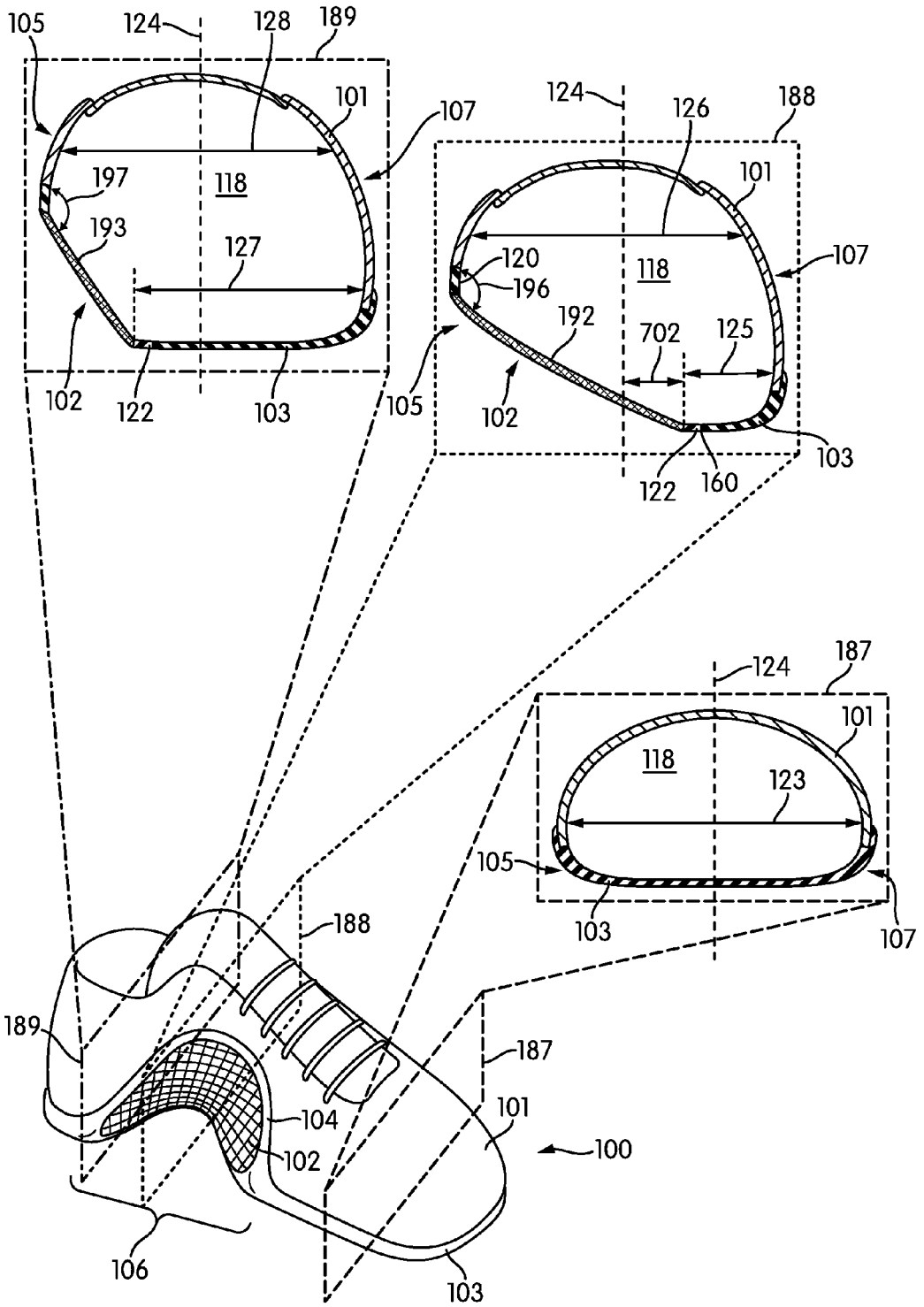
FIG. 7 is a perspective view of the article of footwear, with cross-sectional views taken in a forefoot region and in various positions through the navicular support structure.

Navicular support structure 106 may be positioned so as to reduce the volume of void 118. FIG. 7 shows how the dimensions of void 118 in the medial-to-lateral direction vary from the heel-toe direction of article 100 due to navicular support structure 106. A first slice 187 shows a cross-sectional view of article of apparel 100 in the forefoot region, forward of navicular support structure 106. As seen in first slice 187, upper 101 and sole 103 are symmetrical in cross-section around a centerline 124. Sole 103 has a forefoot width 123 extending across void 118 in this position.

A second slice 188 shows a cross-sectional view of article of apparel 100 in the midfoot region and through navicular support structure 106 at the furthest reach of navicular support structure 106 into void 118. As shown in second slice 188, first portion 192 of pre-sprung material 102 extends from upper frame portion 120 to lower frame portion 122 positioned proximate position 160, which is the widest reach of frame 104 and, correspondingly, the most narrow part of sole 103. In this position, sole 103 has a midsole width 125. Midsole width 125 in this midfoot position is less than toe width 123. In some embodiments, such as the embodiment shown in FIG. 4, the entirety of midsole portion 162 at the furthest extension of navicular support structure 106 into may be positioned on a lateral side of sole 103, as lower frame portion 122 may cut across 124. In some embodiments, position 160 may be in a central portion of a bottom of sole structure 103. In some embodiments, position 160 may be positioned laterally of centerline 124 so that position 160 is between lateral side 107 and centerline 124. Position 160 may be a lateral distance 720 from centerline 124. In some embodiments, lateral distance 720 may be zero or negligible. In some embodiments, lateral distance 720 may be any length or percentage of the distance between centerline 124 and lateral side 107. For example, in some embodiments, lateral distance 720 may be less than or equal to a quarter percentage of the distance between centerline 124 and lateral side 107; in other embodiments, lateral distance 720 may be a quarter to one-half of the distance between centerline 124 and lateral side 107; in other embodiments, lateral distance 720 may be between one-half and three-quarters of the distance between centerline 124 and lateral side 107. In some embodiments, lateral distance 720 may be three-quarters to the entirety of the distance between centerline 124 and lateral side 107. First portion 192 of pre-sprung material 102 is substantially straight as first portion 192 extends from upper frame portion 120 to lower frame portion 122 at a first navicular angle 196. As such, void 118 is not symmetric around centerline 124, with the shape, position, and angle 196 of first portion 192 reducing the volume of void 118 compared to a volume of void 118 if void 118 were symmetrical about centerline 124.

A third slice 189 shows a cross-sectional view of article of apparel 100 heelward of second slice 188 and through navicular support structure 106 at a point where frame 104 is curving towards the outermost perimeter of sole 103. A second portion 193 of pre-sprung material 102 extends in a substantially straight line from upper frame portion 120 to lower frame portion 122 at a second navicular angle 197. Lower frame portion 122 curves away from position 160, so a heelward width 127 of sole 103 is wider than midsole width 125. As such, second navicular angle 197 is more acute than first navicular angle 196. The angle at which pre-sprung material 102 extends from upper frame portion 120 to lower frame portion may change constantly in a heel-toe direction to accommodate the more extreme curvature of lower frame portion 122 compared to upper frame portion 120 in some embodiments. Therefore, even though pre-sprung material 102 may be substantially straight in cross-section in the plane shown by first portion 192 and second portion 193, pre-sprung material 102 essentially curves into void 118 in the orthogonal plane. This curvature may match or substantially match the curvature of an arch region of a wearer so that the inflexible pre-sprung material 102 is comfortable when article 100 is worn and used.

Figure 9:
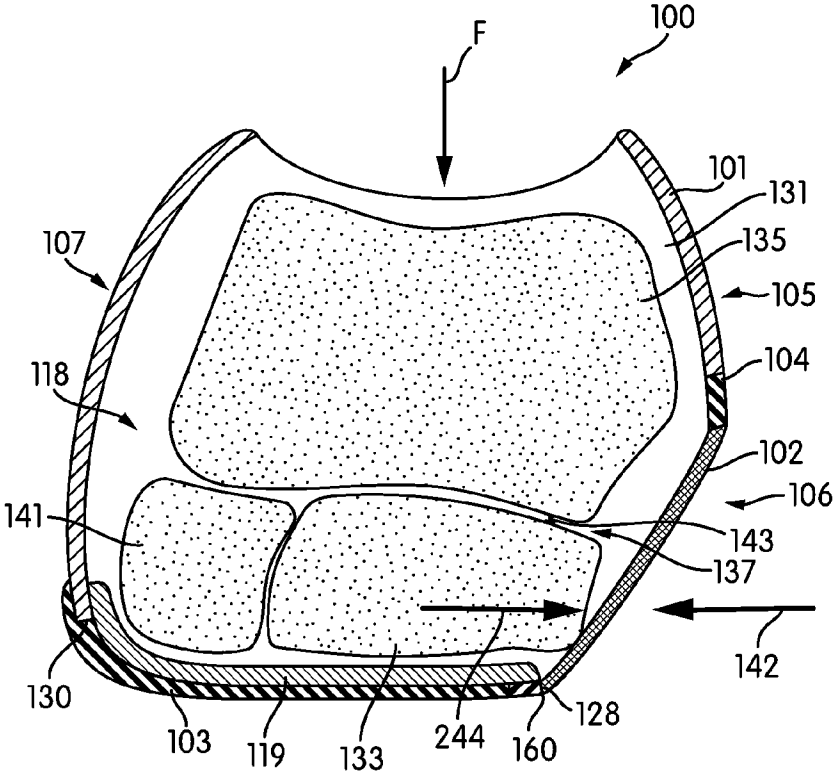
FIG. 9 is a cross-sectional view of an embodiment of an article of footwear with navicular support showing the support of the bones of the talonavicular joint of a foot of a wearer within the article of footwear in response to a force.
Figure 8:
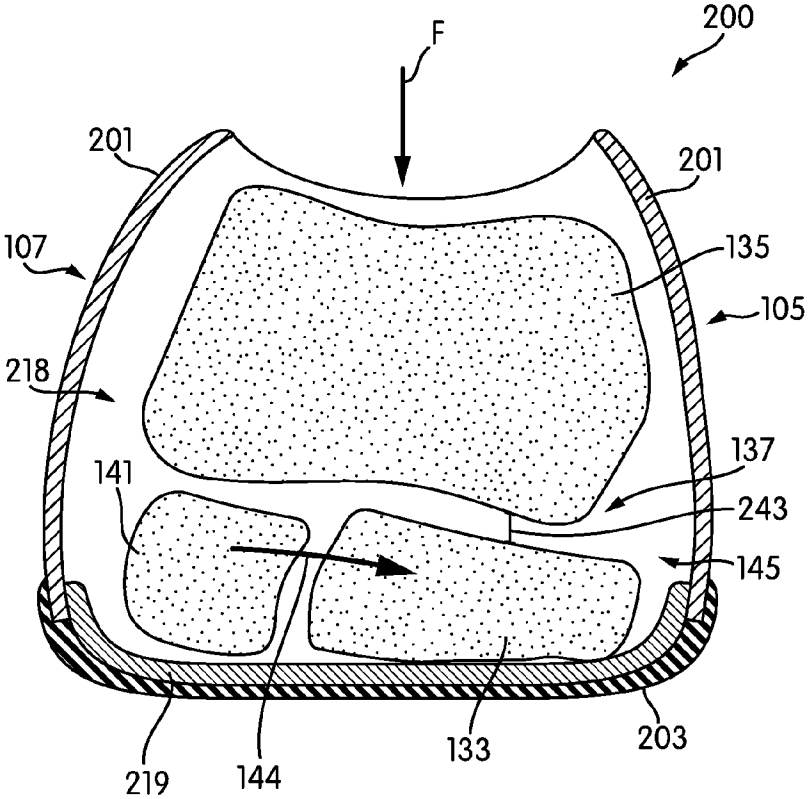
FIG. 8 is a cross-sectional view of a conventional article of footwear showing potential movement of the bones of the talonavicular joint of the foot of a wearer within the conventional article of footwear in response to a force.

FIGS. 5 and 8-9 demonstrate one way in which article 100 may support talonavicular joint 137. FIG. 5 shows the bones of a foot of a wearer within article 100 that incorporates an embodiment of navicular support structure 106. As shown in FIG. 5 and discussed above, pre-sprung material 102 may extend into void 118 of upper 101 to reduce the volume of void 118 and provide less room into which talonavicular joint 137 may expand under pressure. While the proportions may not reflect realistic bone structure and some bones may be enlarged for clarity of this description, pre-sprung material 102 may be aligned with talonavicular joint 137 and navicular bone 133. At rest as shown in FIG. 5, talonavicular joint 137 includes a talonavicular gap 143 between navicular bone 133 and the talus bone 135. As shown in FIG. 5, navicular support structure 106 extends from a point on upper 101 to a beneath upper 101 on sole structure 103.

FIGS. 8 and 9 show the difference between how a talonavicular joint 137 reacts when put into a conventional article of footwear 200 (FIG. 8) and article of footwear 100 (FIG. 9) that includes provisions to support talonavicular joint 137. As shown in FIG. 8, when a force is applied to the foot, as indicated by the arrow, the bones of the foot, including talonavicular joint 137, tend to spread to absorb the forces. When void 118 is not limited by a navicular support structure, as is shown in FIG. 8, the bones of the foot, such as the navicular bone 133, talus bone 135, and cuboid bone 141, move away from each other. The gaps between the bones, such as large talonavicular gap 243, increase. Gap 143 (shown in FIGS. 5 and 9), which is measured when the foot is at rest and not subjected to any forces, is smaller than large talonavicular gap 243, which is measured at the height of the applied force. When not constrained, the bones of the foot will spread as far as the other tissues of the foot permit. While the foot is designed to accommodate these types of stresses by having the bones spread, repeated bone spreads or higher than usual forces may overtax talonavicular joint 137.

However, then constrained by navicular support structure 106 as shown in FIG. 9, navicular bone 133, talus bone 135, and cuboid bone 141 are not able to move as much with respect to each other. Navicular support structure 106 cuts across void 118 to limit the amount of available space proximate talonavicular joint 137 thereby inhibits the spreading of the bones. Further, navicular support structure 106 includes pre-sprung material 102, which has very high stretch-resistance and is under tension. Pre-sprung material 102 may resist the spreading of the bones of the foot because pre-sprung material 102 may yield or flex very little in response to a force. As shown, talonavicular gap 143 has not enlarged compared to FIG. 5.

Further, because pre-sprung material 102 is under tension, pre-sprung material 102 may produce a countering force, as indicated by arrow 142 in FIG. 8. This countering force may assist the foot in resisting the impact force. While the countering force may manifest as resistance, in some embodiments, the countering force may have a trampoline effect. If a trampoline effect occurs, pre-sprung material 102 may push any moving bones back into a comfortable position.

Finally, navicular support structure 106 may deflect the impact force by transferring some of the force to forefoot region (not shown in FIG. 9). This deflection of forces may assist in protecting talonavicular joint 137 by allowing other portions of the foot to absorb the impact forces. The deflection of forces may occur because of the inflexibility and tension of pre-sprung material 102. Because pre-sprung material 102 does not bend or flex in response to the forces, the forces travel through pre-sprung material 102 to other portions of article 100, such as the toe region and/or the heel region. These portions of article 100 may be reinforced to accommodate the forces, such as with a heel counter in heel region 113 or a toe guard in forefoot region 109.

Figure 10:
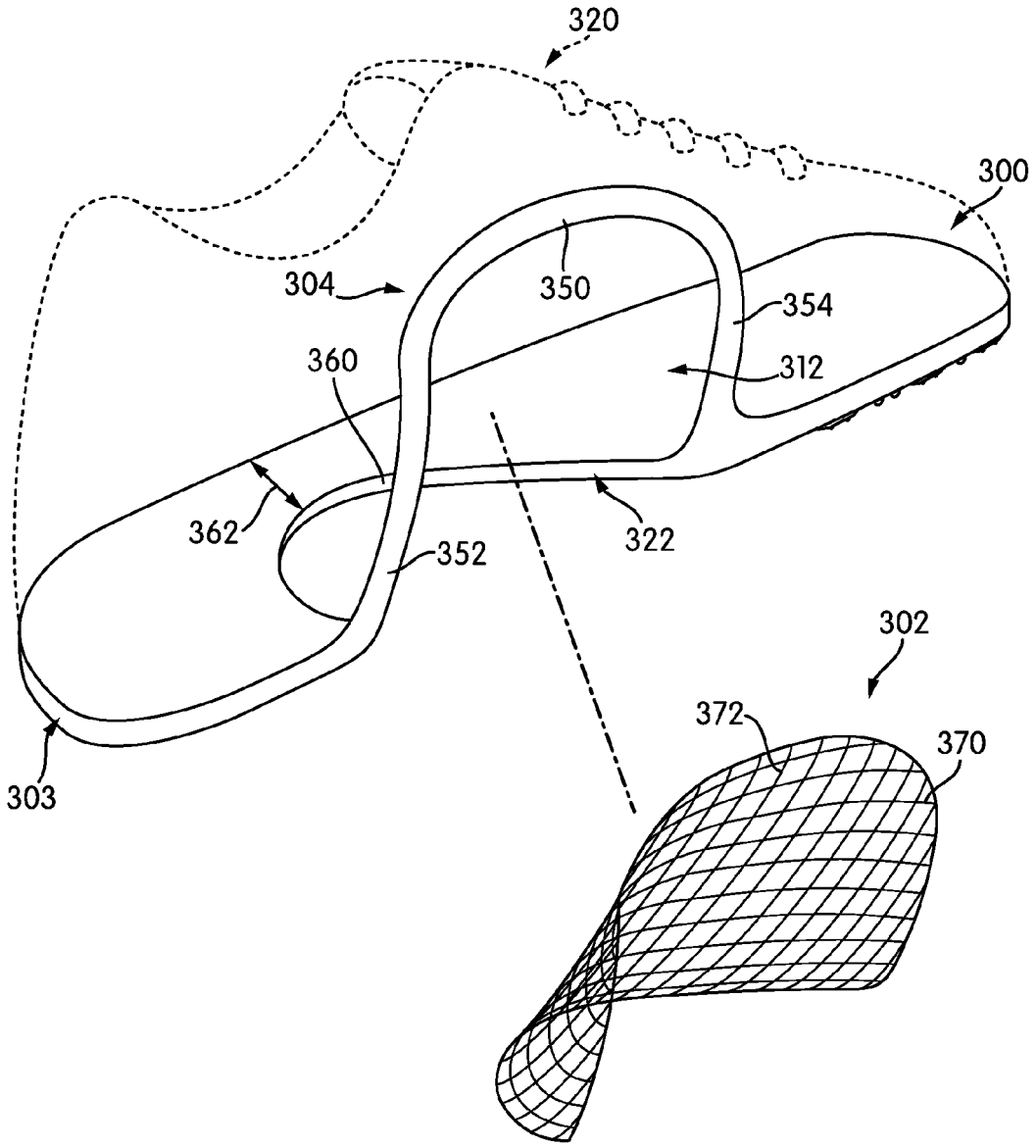
FIG. 10 is an exploded view of another embodiment of an article of footwear having navicular support, with the upper of the article of footwear shown in phantom.
Figure 11:
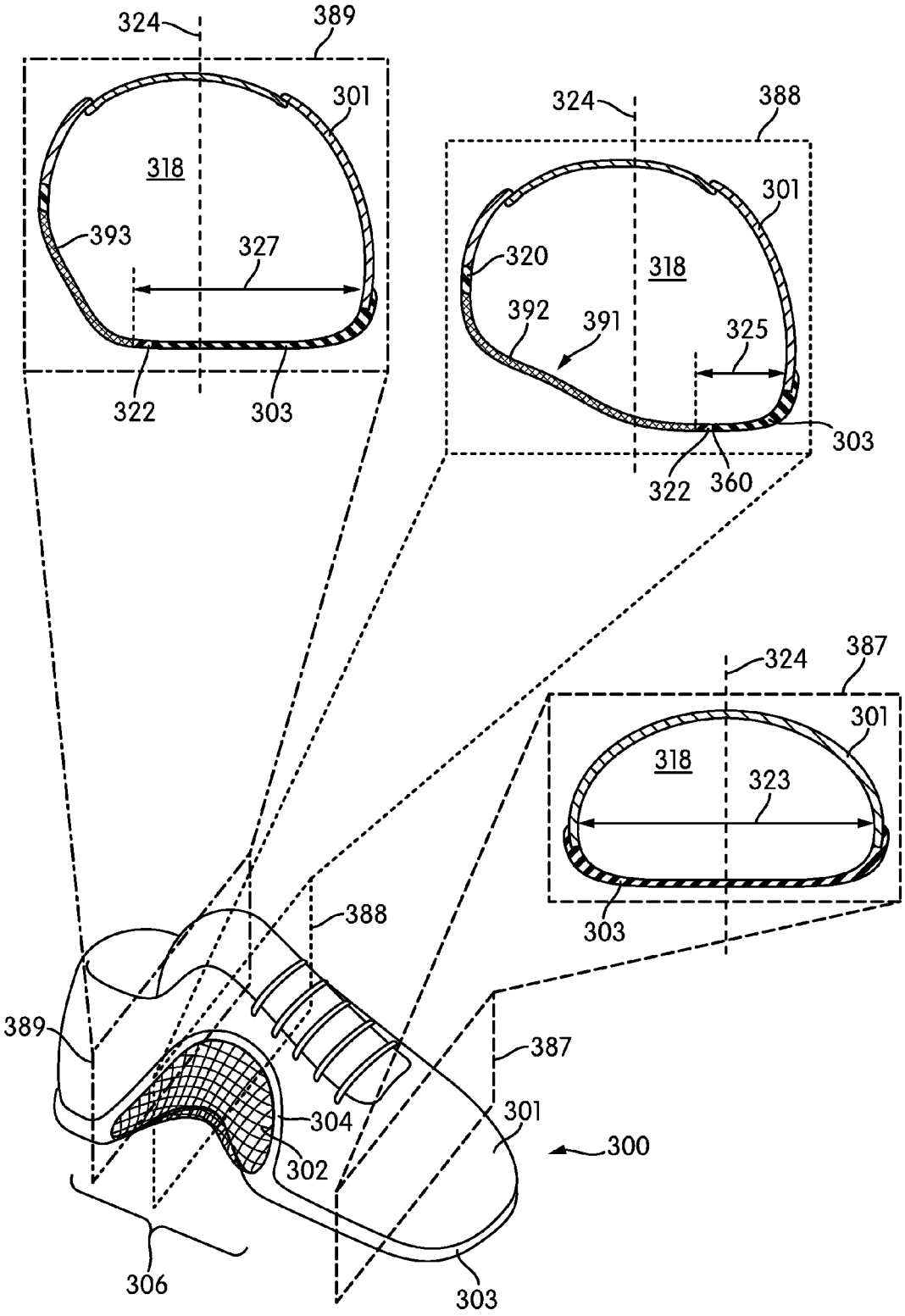
FIG. 11 is a perspective view of the article of footwear of FIG. 10, with cross-sectional views taken in a forefoot region and in various positions through the navicular support structure.

An embodiment of a second article of footwear 300 is shown in FIGS. 10 and 11. Second article of footwear 300 is similar to article of footwear 100 in most respects: second upper 301 may be attached to a second sole structure 303 and a second navicular support structure 306 may extend from second sole structure 303 to a point on second upper 301. Second navicular support structure 306 includes a second frame 304 that defines an aperture and a second pre-sprung material 302 that extends across the aperture. All of the materials and attachment methods for these parts may be the same as those discussed above with respect to second article of footwear 300 discussed above.

In this embodiment, however, second frame 304 may have a compound curvature that imparts a concave cross-sectional shape to second pre-sprung material 302. Second frame 304 may include a heel bar 352 and a toe bar 354. A top bar 350 may extend between and connect heel bar 352 and toe bar 354. Sole frame portion 322 may extend from an outermost sole perimeter to a furthest point 360 positioned proximate the lateral side of second article 300. The curvature of sole frame portion 322 is significantly greater than the curvature of the arcuate portion of second frame 304 formed by heel bar 352, toe bar 354, and top bar 350. Further, the curvature of sole frame portion 322 is in a different plane than the curvature of the arcuate portion of second frame 304 formed by heel bar 352, toe bar 354, and top bar 350. Also, the curvature of top bar 350 may be in a different plane from that of heel bar 352 and toe bar 354. This compound curvature of second frame 304 may impart a curvature to second pre-sprung material 302, even when second pre-sprung material 302 may be a mesh under tension.

Second navicular support structure 306 may be positioned on a medial side of second article 300 so as to reduce the volume of second void 318. FIG. 11 shows how the dimensions of second void 318 in the medial-to-lateral direction vary in the heel-toe direction of second article of footwear 300 due to second navicular support structure 306. A forefoot slice 387 shows a cross-sectional view of second article of footwear 300 in the forefoot region, forward of second navicular support structure 306. As seen in forefoot slice 387, second upper 301 and second sole structure 303 are symmetrical in cross-section around a second centerline 324. Second sole structure 303 has a first width 323 extending across second void 318 in this position.

A midfoot slice 388 shows a cross-sectional view of second article 300 in the midfoot region and through second navicular support structure 306 at the furthest reach of second navicular support structure 306 into second void 318. As shown in midfoot slice 388, first pre-sprung portion 392 extends from second upper frame portion 320 to sole frame portion 322 positioned proximate second position 360, which is the widest reach of second frame 304 and, correspondingly, the most narrow part of second sole structure 303. In this position, second sole structure 303 has a second width 362. Second width 362 in this midfoot position is less than first width 323. First pre-sprung portion 392 has a slight concave curvature as first pre-sprung portion 392 extends from second upper frame portion 320 to sole frame portion 322. The concave curvature has a maximum deflection at inflection point 391. As such, second void 318 is not symmetric around second centerline 324, with the shape, position, and angle of first pre-sprung portion 392 reducing the volume of second void 318 compared to a volume of second void 318 if second void 318 were symmetrical about second centerline 324.

A heelward slice 389 shows a cross-sectional view of second article 300 heelward of midfoot slice 388 and through second navicular support structure 306 at a point where second frame 304 is curving towards the outermost perimeter of second sole structure 303. A second pre-sprung portion 393 extends in a slightly concave line from second upper frame portion 320 to sole frame portion 322. Sole frame portion 322 curves away from second position 360, so a third width 327 of second sole structure 303 is wider than second width 325. Similar to article 100 discussed above, the angle at which second pre-sprung material 302 extends from upper frame portion 320 to lower frame portion changes constantly in a heel-toe direction to accommodate the more extreme curvature of sole frame portion 322 compared to second upper frame portion 320. Therefore, even though second pre-sprung material 302 may be substantially concave in cross-section in the plane shown by first pre-sprung portion 392 and second pre-sprung portion 393, second pre-sprung material 302 also curves into second void 318 in the plane orthogonal to the plane of the slices showing first pre-sprung portion 392 and second pre-sprung portion 393. This curvature may match or substantially match the curvature of an arch region of a wearer so that the inflexible second pre-sprung material 302 is comfortable when second article 300 is worn and used.

In further configurations, upper 101 and/or second upper 301 may include additional elements such as logos, trademarks, and placards with size information, care instructions, and/or material information.

Further variations to the articles of footwear will be readily apparent to those of ordinary skill in the art. For example, in other embodiments, sole structure 103 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

While various embodiments of the invention have been described, the description is intended to be exemplary, rather than limiting and it will be apparent to those of ordinary skill in the art that many more embodiments and implementations are possible that are within the scope of the invention. Further, any element of any embodiment, either described or shown, may be used with or as a replacement for another element in another embodiment unless specifically limited to the embodiment in discussion. Accordingly, the invention is not to be restricted except in light of the attached claims and their equivalents. Also, various modifications and changes may be made within the scope of the attached claims.

What is claimed is:

1. An article of footwear comprising:

an upper;

a sole structure attached to the upper so that the sole structure forms a lower surface of the article of footwear; and a navicular support structure, wherein the navicular support structure includes a frame and a pre-sprung material, wherein the frame extends from a point on the lower surface of the sole structure of the article of footwear to a point on a medial sidewall of the upper in the midfoot portion of the article of footwear, the pre-sprung material extends between a heel-side upwardly-extending portion of the frame and a forefoot-side upwardly-extending portion of the frame, and the pre-sprung material curves inward towards a lateral side of the article of footwear between the heel-side upwardly-extending portion and the forefoot-side upwardly-extending portion.

2. The article of footwear of claim 1, wherein the frame is made from a material that is more rigid than the pre-sprung material.

3. The article of footwear of claim 1, wherein the frame includes an aperture, and the pre-sprung material is disposed within the aperture.

4. The article of footwear of claim 3, wherein the frame has a compound curvature so that the pre-sprung material has a concave curvature within the aperture.

5. The article of footwear of claim 3, wherein the frame has an arcuate shape on the upper of the article of footwear.

6. The article of footwear of claim 3, wherein the frame extends from a lateral portion of the sole structure to a position on the upper.

7. The article of footwear of claim 6, wherein the frame includes a sole frame portion associated with the sole structure and an upper frame portion positioned on and following the contours of the upper.

8. The article of footwear of claim 7, wherein the sole frame portion and the upper frame portion are connected by a bend.

9. The article of footwear of claim 1, wherein the pre-sprung material forms a portion of an exterior surface of the article of footwear.

10. The article of footwear of claim 1, wherein the navicular support structure is exposed on at least one of the upper and the sole structure.

11. The article of footwear of claim 1, wherein a center of the navicular support structure is adapted to align with a talonavicular joint of a wearer when the article of footwear is worn by a user.

12. The article of footwear of claim 1, wherein the pre-sprung material includes poly-paraphenylene terephthalamide.

13. An article of footwear comprising:

an upper made of a first material having a first stretch resistance and a first material rigidity;

a sole structure associated with the upper, wherein the sole structure is made from a second material;

a frame that extends from the sole structure to the upper, wherein the frame is made of a third material having a second material rigidity; and a pre-sprung material surrounded by the frame, wherein the pre-sprung material has a second stretch-resistance, wherein the first stretch resistance is less than the second stretch resistance, wherein the third material rigidity is greater than the first material rigidity, and wherein the pre-sprung material extends between a heel-side upwardly-extending portion of the frame and a forefoot-side upwardly-extending portion of the frame, and the pre-sprung material curves inward from a medial side of the article of footwear towards a lateral side of the article of footwear between the heel-side upwardly-extending portion and the forefoot-side upwardly-extending portion.

14. The article of footwear of claim 13, wherein the third material is the same as the second material.

15. The article of footwear of claim 13, wherein the frame defines an aperture, and wherein the pre-sprung material is disposed within and extends across the aperture.

16. The article of footwear of claim 15, wherein a first portion of the frame is defined by the sole structure and a second portion of the frame is disposed on the upper.

17. The article of footwear of claim 16, wherein both the first portion and the second portion of the frame are curved, and wherein the curvature of the frame is designed to support the pre-sprung material in a concave configuration.

18. The article of footwear of claim 13, wherein the pre-sprung material forms an outer surface of both the upper and the sole structure so that the pre-sprung material is exposed.

19. The article of footwear of claim 13, wherein the pre-sprung material has substantially no stretch.

20. The article of footwear of claim 13, wherein the pre-sprung material is a mesh.

21. An article of footwear having a forefoot region, a midfoot region, and a heel region, the article of footwear comprising:

an upper;

a sole structure attached to the upper;

a support assembly disposed in the midfoot region, the support assembly comprising a frame defining an aperture and a pre-sprung material disposed in the aperture, wherein the frame extends from a position on the sole structure to a position on a medial side in a midfoot portion of the upper, wherein the support assembly is configured to transfer force from the midfoot region to the forefoot region, and wherein the pre-sprung material extends between a heel-side upwardly-extending portion of the frame and a forefoot-side upwardly-extending portion of the frame, and the pre-sprung material curves inward towards a lateral side of the article of footwear between the heel-side upwardly-extending portion and the forefoot-side upwardly-extending portion.

22. The article of footwear of claim 21, wherein the support assembly is adapted to align with a talonavicular joint of a wearer of the article of footwear when the article of footwear is worn by the wearer.

23. The article of footwear of claim 21, wherein the support assembly has a curvature so that the pre-sprung material is concave with respect to the rest of the upper.

24. The article of footwear of claim 21, wherein the pre-sprung material is strung onto the frame.

25. The article of footwear of claim 21, wherein the frame and the sole structure are continuous.

* * * * *